US011742555B1

(12) United States Patent
Weems et al.

(10) Patent No.: US 11,742,555 B1
(45) Date of Patent: Aug. 29, 2023

(54) SEPARABLE SELF-ALIGNING WAVEGUIDE CONNECTOR USING A BALL DETENT ASSEMBLY HAVING BALL ELEMENTS ENGAGED WITH MATING DIVOTS

(71) Applicant: Lockheed Martin Corporation, Bethesda, MD (US)

(72) Inventors: Weyman Albert Weems, Littleton, CO (US); Daniel Schirmer Zettler, Castle Rock, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 31 days.

(21) Appl. No.: 17/374,191

(22) Filed: Jul. 13, 2021

(51) Int. Cl.

| | |
|---|---|
| ***H01P 1/04*** | (2006.01) |
| ***H01P 5/02*** | (2006.01) |
| ***H01P 11/00*** | (2006.01) |
| ***H01P 3/12*** | (2006.01) |

(52) U.S. Cl.
CPC ..... *H01P 1/042* (2013.01); *H01P 3/12* (2013.01); *H01P 5/02* (2013.01); *H01P 11/002* (2013.01)

(58) Field of Classification Search
CPC ..... H01P 1/042; H01P 11/002
USPC ..... 333/254
See application file for complete search history.

(56) References Cited

U.S. PATENT DOCUMENTS

2020/0235448 A1* 7/2020 Pollock ..... H01Q 13/02

* cited by examiner

*Primary Examiner* — Benny T Lee

(57) ABSTRACT

Provided herein are various examples of separable waveguide couplers. In one example, a collar element is provided to surround a member comprising a faying surface, a waveguide conduit, and alignment protrusions arranged radially about a perimeter of the faying surface, where the collar element is configured to accept insertion of a mating member comprising a mating faying surface and a mating waveguide conduit. A ball detent assembly is provided having a spring element that retains ball elements in holes formed through the collar element. The waveguide conduit and the mating waveguide conduit are configured to be aligned radially by at least engagement of the alignment protrusions with alignment channels in the mating member and restrained axially by at least engagement of the ball elements with mating divots in the mating member.

20 Claims, 6 Drawing Sheets

SEPARABLE SELF-ALIGNING WAVEGUIDE CONNECTOR USING A BALL DETENT ASSEMBLY HAVING BALL ELEMENTS ENGAGED WITH MATING DIVOTS

GOVERNMENT RIGHTS STATEMENT

This invention was made with Government support under contract no. 160660 awarded by the National Aeronautics and Space Administration (NASA). The Government has certain rights in the invention.

TECHNICAL BACKGROUND

Waveguides and similar structures comprise conduits which carry radio frequency (RF) signals between endpoints using internal signal conductance. Often, waveguides are employed in communication systems that use microwave RF signals, and can be installed in communication uplinks and downlinks that carry transmit (Tx) or receive (Rx) signals between transceiver equipment and antenna elements. However, waveguides can be difficult to design and manufacture due in part to the high sensitivity of waveguides to manufacturing precision, symmetry, and geometry which can lead to distortions like passive intermodulation (PIM). PIM results in undesirable distortion, non-linearity, or mixing among signals within waveguides from physical properties of the waveguide, such as mechanical interfaces, surface defects, alignment, materials, or improperly designed geometric features. Moreover, joining segments of waveguides together can present a challenge, and often require permanent coupling using bolts and precision-manufacturing joint faces. While coaxial cables can be employed instead of waveguides, coaxial cables have limitations on power, bandwidth, and signal integrity which make waveguides more suited to many applications or missions.

When a situation occurs for separable or connectable bodies or vehicles, such as is the case during entry, descent, and landing (EDL) separation between an entry vehicle and lander vehicle on other planets or moons, communication between a command node and antenna on the separable vehicles needs to be maintained throughout the EDL process. This process is enabled by maintaining an RF link between transmitters/receivers and antennas of the vehicles. Then, a lander vehicle or other separable body is released from an entry vehicle, and communication links would be physically severed. On some missions, the RF link between a lander vehicle and entry vehicle can been maintained through either a coaxial cable with a separation connector or through the use of waveguide and a hat coupler comprising a conductive funnel structure. Due to the ever increasing distances of communication links and increasing amount of communication bandwidth desired, coaxial cables are often insufficient for required power or data integrity at the higher communication frequencies. Also, hat couplers have limitations with regard to size/volume, misalignment, and signal loss over what amounts to an air gap between a waveguide port/aperture and an enveloping funnel structure that is coupled to a further waveguide segment.

OVERVIEW

Provided herein are various examples of separable waveguide connectors or couplers. The separable waveguide connectors discussed herein provide low signal loss coupling between segments of waveguides, able to be repeatedly coupled or decoupled. For example, when a spacecraft lander separates from an entry vehicle, a waveguide communication link can be severed between a transmitter/receiver and an antenna, which are previously coupled using the waveguide to carry microwave radio frequency (RF) communication signaling. Other example applications include terrestrial communication systems which employ waveguides. The separable waveguide connectors discussed herein can enable automated or remote assembly of telecommunication systems within manufacturing facilities or when remotely performed at inhospitable areas (i.e. space, orbit, sub-surface). Precision alignment between mating waveguides is established using various radial and axial alignment and retention features. Various manufacturing techniques discussed herein can provide for further precision in alignment of the mating waveguides to reduce signal loss, signal reflection, and signal mixing.

In one example, a collar element is provided to surround a member comprising a faying surface, a waveguide conduit, and alignment protrusions arranged radially about a perimeter of the faying surface, where the collar element is configured to accept insertion of a mating member comprising a mating faying surface and a mating waveguide conduit. A ball detent assembly is provided having a spring element that retains ball elements in holes formed through the collar element. The waveguide conduit and the mating waveguide conduit are configured to be aligned radially by engagement of the alignment protrusions with alignment channels in the mating member and restrained axially by engagement of the ball elements with mating divots in the mating member.

Another example includes a separable waveguide connector system that includes a first connector assembly and a second connector assembly. The first connector assembly includes a collar element surrounding a member comprising a faying surface, a waveguide conduit, and alignment protrusions arranged radially about a perimeter of the faying surface. The first connector assembly also includes a ball detent assembly having a spring element that retains ball elements in holes formed through the collar element. The second connector assembly includes a mating member comprising a mating faying surface having alignment channels, a mating waveguide conduit, and mating divots formed along an outer edge of the mating member. The mating member is configured to be inserted into the collar element, with alignment of the waveguide conduit with the mating waveguide conduit established by at least engagement of the alignment protrusions with alignment channels and engagement of the ball elements with mating divots.

A further example includes a method of manufacturing a separable waveguide coupler system. The method includes forming a first member comprising a first faying surface, a first waveguide conduit, and alignment protrusions arranged radially about a perimeter of the first faying surface, forming a connector assembly comprising the first member coupled to a collar element surrounding a perimeter of the first member, and forming a ball detent assembly by at least attaching a spring element to the collar element retain ball elements within holes formed into the collar element. The method also includes forming a second member comprising a second faying surface having alignment channels, a second waveguide conduit, and mating divots formed along an outer edge of the second member, where the second member is sized to be insertable into the collar element to mate the first faying surface to the second faying surface.

This Overview is provided to introduce a selection of concepts in a simplified form that are further described below in the Detailed Description. It may be understood that this Overview is not intended to identify key features or essential features of the claimed subject matter, nor is it intended to be used to limit the scope of the claimed subject matter.

BRIEF DESCRIPTION OF THE DRAWINGS

Many aspects of the disclosure can be better understood with reference to the following drawings, where like features are denoted by the same reference labels throughout the detail description of the drawings. While several implementations are described in connection with these drawings, the disclosure is not limited to the implementations disclosed herein. On the contrary, the intent is to cover all alternatives, modifications, and equivalents.

DETAILED DESCRIPTION

Figure 1:
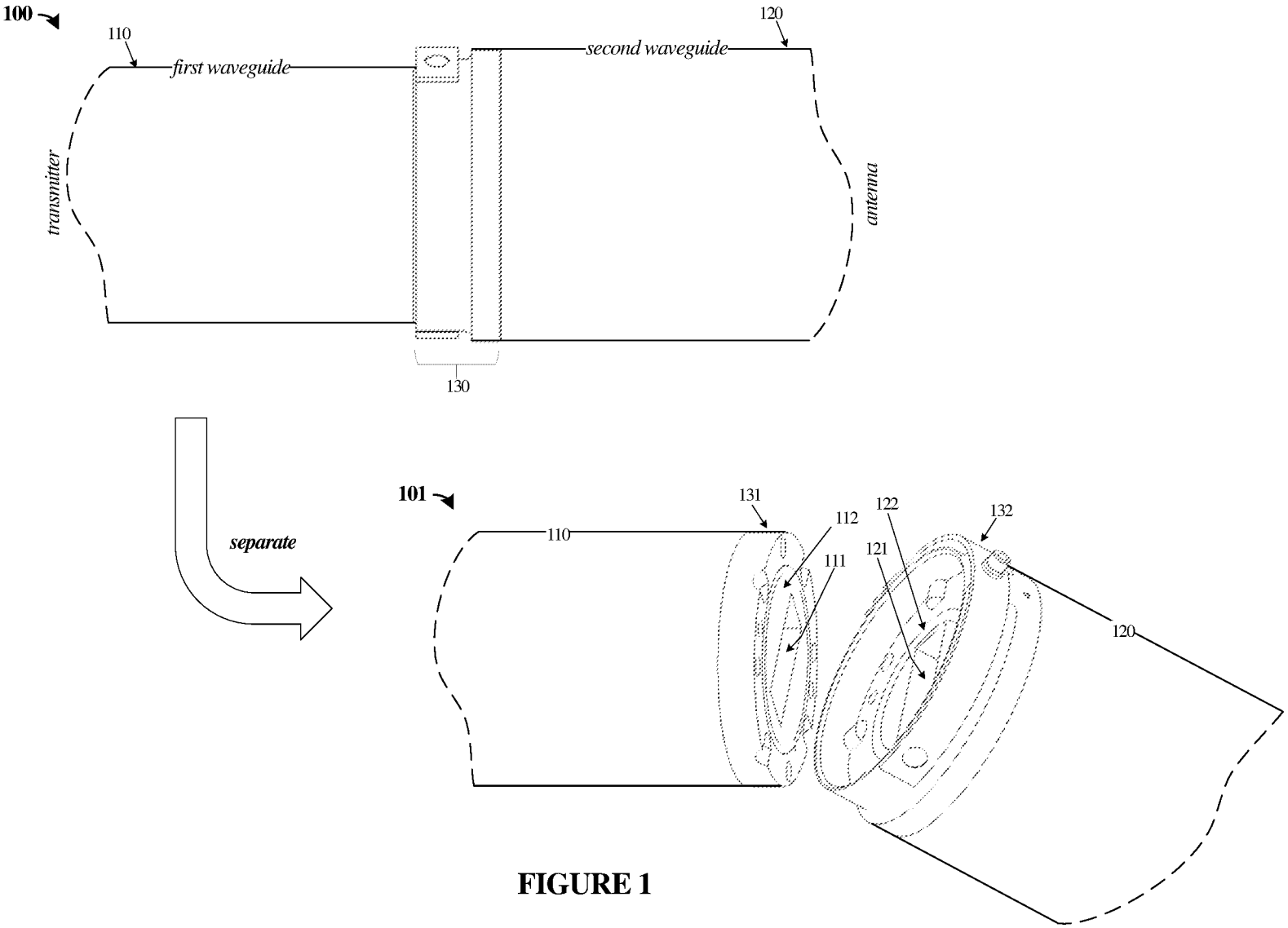
FIG. 1 illustrates an example waveguide coupling in an implementation.

Discussed herein are various examples of separable waveguide connectors, which can be referred to as waveguide couplers, that provide physical coupling between segments of waveguides. Precision alignment between mating waveguides is established using enhanced radial and axial alignment and retention features shown in the various Figures. Several manufacturing techniques discussed herein can provide for further precision in alignment of the mating waveguides to reduce signal loss, signal reflection, and signal mixing. The separable waveguide connectors provide low-loss coupling among waveguides with continuation of signal pathways between deployable bodies across a separation interface. When one body deploys from another, the two halves of the connector are pulled cleanly apart without the shock and foreign-object debris associated with pyrotechnic elements or frangible fasteners. This configuration allows for repeatable engagements and disengagements without a need for the installation or removal of any external hardware such as screws, bolts, washers, and the like. Moreover, automated, remote, or large-scale manufacturing can be implemented to join waveguide segments using the enhanced connectors or couplers herein, due in part to the absence of external hardware for connection to be made. Such techniques and assemblies can be applied over a range of operating frequencies and internal waveguide conduit configurations/sizes, such as for two or more parallel waveguide conduits.

The connector includes two assemblies that form halves of a waveguide flange which are match-machined to ensure alignment. One half of the connector comprises a first assembly that contains alignment pins and the other half of the connector comprises a second assembly that contains mating cutouts for the alignment pins, ensuring repeatable, consistent alignment of an associated waveguide conduit within each of the two halves. The two connector halves are restrained or held together axially (i.e. along the length of the waveguide) by a collar that has spring-loaded ball detents. The ball detents keep the two halves in contact with one another until separation is desired by application of a separation force that exceeds a holding force of the ball detents. This holding force can be customized to withstand various vibrations and shocks experienced before deployment is desired. Alignment of the waveguide conduit walls as well as establishment of an electrically conductive path between the separable halves provides for operation of a continuous waveguide path through the separable waveguide connector.

Advantageously, the separable waveguide connectors discussed herein can result in significantly lower connection losses than the other techniques for coupling RF connections. As mentioned above, both coaxial cable connectors and waveguide hat couplers have been employed in the past. Both the hat coupler and use of coaxial cable result in high signal loss. For example, although a separable connector for a coaxial cable can be a low-loss device, the coaxial cable itself for X-band microwave frequencies has approximately 0.026 dB of signal loss per inch compared to only 0.004 dB of signal loss for the same length of waveguide. This coaxial signal loss over the length of a signal link can be unacceptable for many applications and frequency ranges. Also, the use of a hat coupler and waveguide reduces the loss per inch with respect to coax, but the hat coupler itself has high losses which results in undesirable performance. The separable waveguide connectors discussed herein overcome both the line loss limitations of coaxial cable and the coupler loss limitations of hat couplers.

Turning now to a first example of a waveguide coupling arrangement, FIG. 1 is provided. FIG. 1 includes arrangements which shows two waveguides 110 and 120 coupled using a separable waveguide connector 130. Arrangement 100 shows waveguides 110 and 120 presently joined via separable waveguide connector 130. Arrangement 101 shows waveguides 110 and 120 after separation. Although a detailed discussion on example elements of waveguide connector 130 are included in further Figures, a brief discussion is included for FIG. 1.

Specifically, first waveguide 110 comprises a waveguide segment coupled to a transmitter or receiver and carries RF signals within an internal waveguide conduit (not shown) aligned to the waveguide conduit 111 of first connector portion 131. First waveguide 110 is installed to first connector portion 131 which includes waveguide conduit 111 and various other coupler elements. When coupled, such as in arrangement 100, faying surface 112 is mated with faying surface 122 of second connector portion 132 which also has waveguide conduit 121 and various other coupler elements. Second connector portion 132 is coupled to second waveguide 120. Second waveguide 120 comprises a waveguide segment mated to an antenna, antenna array, or antenna interface system and carries RF signals within an internal waveguide conduit (not shown) aligned to waveguide conduit 121.

Separable waveguide connector 130 thus maintains an RF interface between a first waveguide pathway and a second waveguide pathway. Various detents and alignment features (discussed below) ensure alignment of waveguide cavities as well as the contact of the faying surfaces of the two connector halves. Circumferential detents and planar (radial) alignment pins ensure alignment of the waveguide cavities. Small deviations in the coupling of the faying surfaces can be mitigated using a resonant conduit and conductive electromagnetic interference (EMI) seal. These enhanced features result in significantly reduced losses across a waveguide connection interface.

Although FIG. 1 shows a first connector portion/type coupled to first waveguide 110, either of the connector halves can be coupled to first waveguide 110 or second waveguide 120, and vice versa, as long as the mating connector portion is on the opposite waveguide in the connection interface. Also, the connector portions can be coupled to the waveguides 110 and 120 using waveguide coupling features that couple to waveguide segments. These features can include standardized bolt patterns to fit to a targeted waveguide type, or can instead comprise weld interfaces. Thus, a first surface of each connector half comprises the faying surface, and a second surface of each connector comprises a waveguide interface. Other examples may have the connector half manufactured directly into corresponding segments of waveguide or connected using welds, adhesives, fasteners, or other techniques. The waveguide segments can comprise rigid or flexible waveguide types, which may include rigid waveguides coupled to flexible or compliant mounts of the associated vehicles or deployable bodies.

Figure 2:
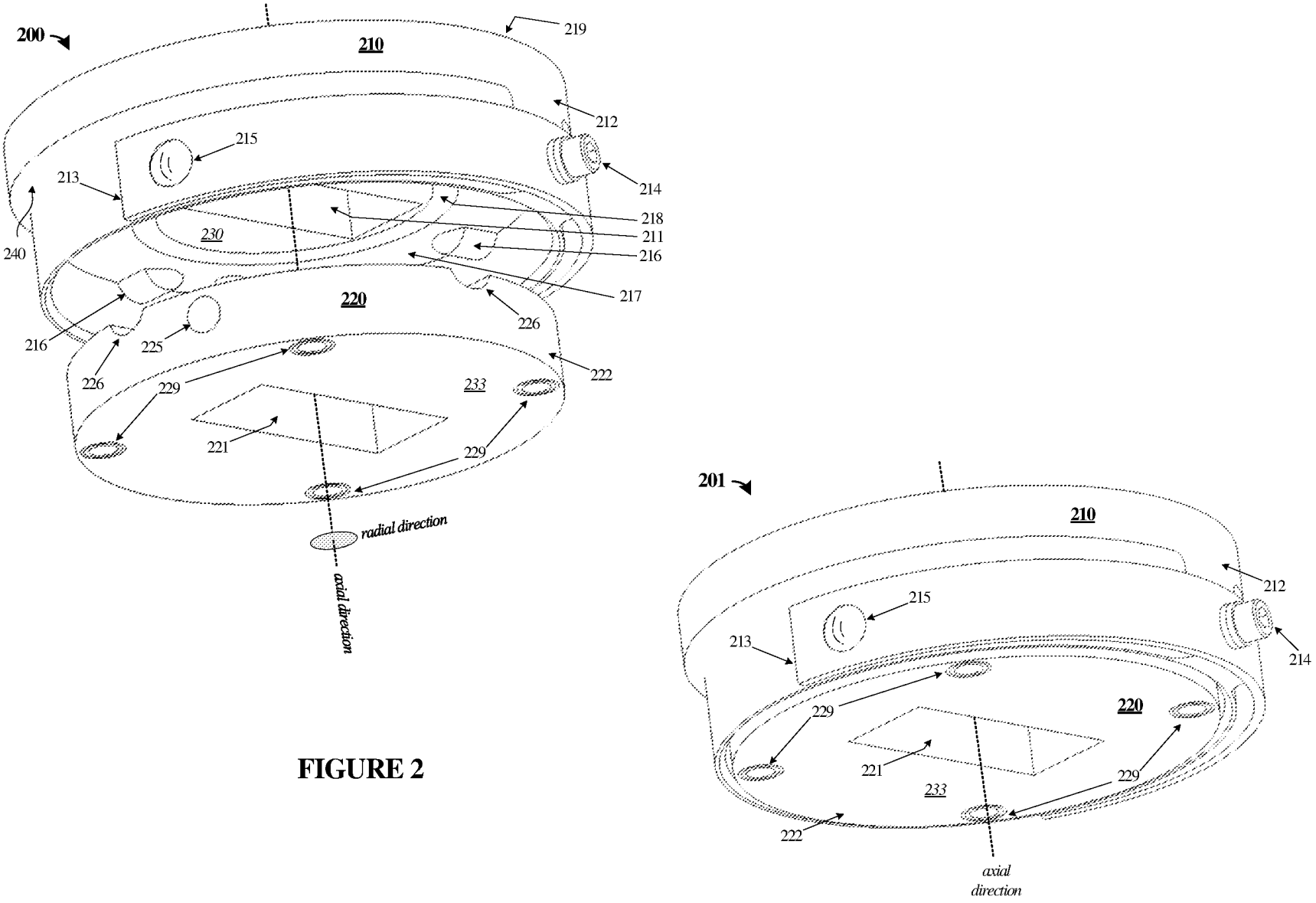
FIG. 2 illustrates a waveguide coupler arrangement in an implementation.

FIG. 2 illustrates a detailed view of a separable waveguide connector and associated portions or halves. View 200 is an isometric view illustrating connector portion 210 and connector portion 220 in a separated or decoupled configuration. View 201 is an isometric view illustrating connector portion 210 and connector portion 220 in a coupled or nested configuration. An axial direction is labeled in FIG. 2, indicating an axis along the length of the waveguide portions. A radial direction is perpendicular to the axial direction, but within the same plane as the faying surfaces indicated below. Although rectangular waveguide portions and cavities are discussed in the context of FIG. 2 and further Figures, it should be understood that different shape and size configurations of waveguide can be employed. These configurations include rectangular, square, circular, elliptical, or configurations with more than one waveguide (separate or ridged) within a shared connector. For example, one waveguide type might include a double ridged waveguide type, or dual waveguides of a particular type.

Connector portion 210 comprises an assembly made among collar element 212 and body member 217. This assembly includes rectangular waveguide conduit 211 formed within member 217. Collar element 212 surrounds member 217 and overlaps member 217 on at least a side of member that has faying surface 230. Thus, collar element 212 with member 217 forms a "socket" able to couple to a "plug" formed from member 222 of connector portion 220. Connector portion 210 also includes leaf spring element 213 mounted within spring recess 240, spring attachment element 214, ball elements 215, alignment protrusions 216, resonant cavity 218, and waveguide interface features 219 on waveguide interface surface 231 (hidden in this view). Connector portion 220 includes body member 222 which includes rectangular waveguide conduit 221 formed within member 222 and having faying surface 232 (hidden in this view). Member 222 also includes divots 225 (1 shown, 1 hidden in this view), alignment channels 226, and waveguide interface features 229 on waveguide interface surface 233.

As mentioned above, FIG. 2 includes two views. While view 200 illustrates a decoupled configuration (pre-insertion or post-separation), view 201 illustrates a coupled configuration. During insertion, connector portion 210 and connector portion 220 are brought into close relation and roughly aligned via the orientation of the associated waveguide cavities. From here, alignment protrusions 216 will fit into alignment channels 226 and be guided into alignment in the radial direction, where faying surface 230 and faying surface 232 are brought into close proximity Waveguide conduit 211 and waveguide conduit 221 are then mated and aligned radially. Axial alignment and retention are provided by contact and movement of ball elements 215 along an outer perimeter of member 222 and finally into divots 225. Ball elements 215 are retained into holes formed through collar element 212 by spring element 213, and ball elements 215 provide an axial retention or restraining force when seated into divots 225. Ball elements 215 and divots 225 also provide alignment in the axial direction when ball elements 215 are seated into divots 225. An adjustable spring force can be provided by selection of materials and thicknesses of spring element 213, the lever arm length between ball elements 215 and spring attachment element 214. Spring element 213 wraps around a portion of collar element 212 and positions ball elements 215 into a cavity formed by spring recess 240, which provides for lever movement of spring element 213 with regard to collar element 212 and the attachment point on collar element 212 of spring attachment element 214. In this manner, ball elements 215 are held fast to collar element 212 while a portion of ball elements 215 penetrate collar element 212 and can contact divots 225.

Advantageously, alignment and retention in the axial and radial directions as well as alignment of rectangular waveguides are provided by the configurations shown in FIG. 2. Faying surfaces of each connector portion are brought and held in close proximity to each other for conductive or at least RF-quality coupling between the faying surfaces and associated waveguides. As will be discussed below, a resonant cavity (218) and electromagnetic (EM) seal cavity 228 are provided to further enhance conductivity and RF coupling performance of the two-part waveguide connector described herein. The connectors described herein can be employed for coupling waveguides of various types and sizes, such as for coupling X-band waveguides in the frequency range of 7-11 gigahertz (GHz), among other bands and ranges. Also, although FIG. 2 shows a single rectangular waveguide, it should be understood that more than one waveguide can be included in the same connector, or waveguides of different cross-sectional configurations.

Figure 3:
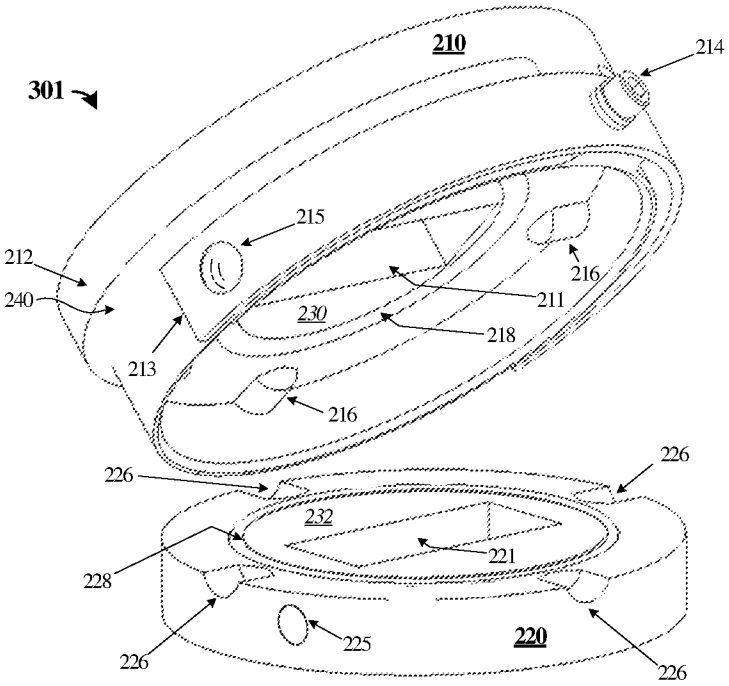
FIG. 3 illustrates a waveguide coupler arrangement in an implementation.
Figure 3:
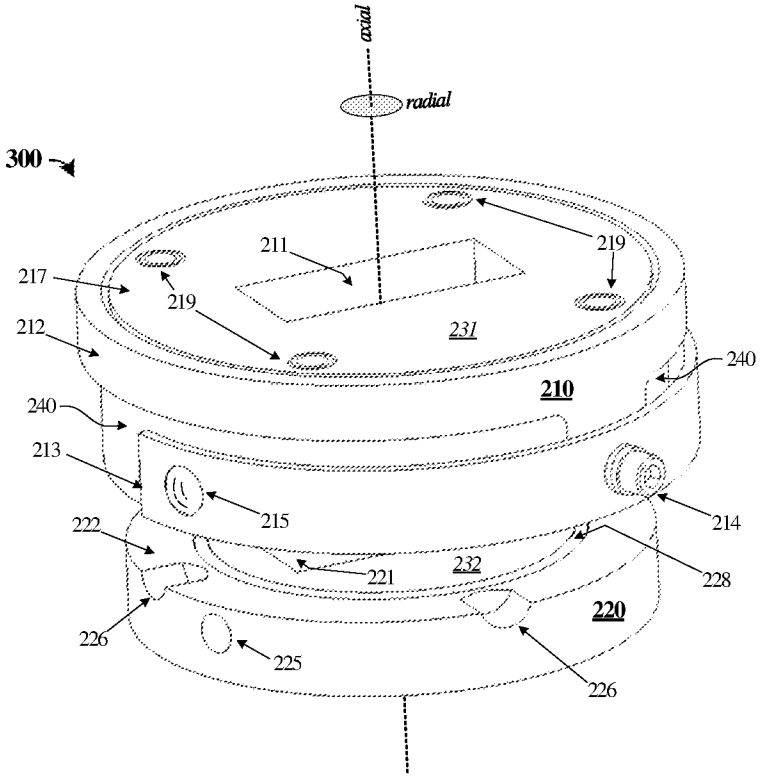

FIG. 3 illustrates an additional detailed view of a separable waveguide connector and associated portions or halves. View 300 is an isometric view illustrating connector portion 210 and connector portion 220 in a decoupled configuration. View 301 is an isometric view illustrating connector portion 210 and connector portion 220 in a tilted configuration. An axial direction is labeled in FIG. 3, indicating an axis along the length of the waveguide portions. A radial direction is perpendicular to the axial direction, but within the same plane as the faying surfaces. Although similar elements are included in FIG. 3 as found in FIG. 2, it should be understood that variations are possible.

In particular, the views in FIG. 3 allow for visibility of waveguide interface features 219 of connector portion 210 located on waveguide interface surface 231. Waveguide interface surface 231 comprises a flange or other mechanical interface configured to mate to a waveguide or portion of a waveguide. A bolt pattern of waveguide interface features 219 can be selected to mate to standardized waveguide flanges, such as the WR-22 or WR-430 waveguide sizes, among others. Waveguide conduit 211 also can be sized and shaped to conform to the selected waveguide size which couples to waveguide interface features 219. For example, waveguides 110 or 120 in FIG. 1 might terminate in a flange having a bolt or bolt hole pattern that is similar to that of waveguide interface features 219 and can be coupled using bolts, other fastener types, welds, or adhesives to connector portion 210. A similar configuration is found for connector portion 220, although hidden from view in FIG. 3. FIG. 2 (above) also illustrates waveguide interface features 229 and waveguide conduit 221 on waveguide interface surface 233.

FIG. 3 also shows spring element 213 positioned into a cavity formed by spring recess 240, coupled to collar element 212 via spring attachment element 214, with ball elements 215. Faying surfaces 230 and 232 are also visible in view 301 of FIG. 3. Faying surface 232 comprises alignment channels 226 which fit with alignment protrusions 216 on faying surface 230, both of which are disposed along a perimeter of the associated faying surface and aligned along a radial direction. The radial length of alignment protrusions 216 and alignment channels 226 can depend on the size of members 217/222 as well as the corresponding waveguide cavities. Thicknesses of alignment protrusions 216 and depths of alignment channels 226 can vary based on the material thickness of members 217/222, as well as desired radial alignment forces needed to secure alignment protrusions 216 into alignment channels 226 during misalignment scenarios. A quantity of alignment protrusions 216 and associated alignment channels 226 can be selected to maximize radial alignment and provide any desired protrusion redundancy, while limiting the required quantity which drives weight and complexity.

Although precision alignment between faying surfaces of each of the connector portions is achieved using the enhanced configurations discussed herein, mechanical machining tolerances, thermal expansion/contraction of materials, and other factors can lead to variations in the contact between the faying surfaces. Resonant cavity (also referred to as a choke) 218 is provided to reduce sensitivity of the connector to gaps between faying surfaces. Resonant cavity 218 comprises a concentric RF resonant cavity surrounding waveguide conduit 211 which allows for attenuation of reflections, signal self-mixing, and other effects, such as PIM. The depth of resonant cavity 218 into member 212 can be selected based on desired RF properties and the thickness of member 212. A gap might be established when the connector is coupled between the faying surfaces which extends from the waveguide cavities to resonant cavity 218—forming a merged resonant volume containing the faying surface gap, resonant cavity 218, and the waveguide cavities. This gap/volume might further extend to EM seal cavity 228 which can include an embedded EM seal, also referred to as an electromagnetic interference (EMI) seal which mechanically takes up any gap between the faying surfaces by providing a flexible conductive seal. Various EMI seals can be employed, such as rings formed from springs/coils, conductive-impregnated rubber or silicone rings, conductive fingers, or other configurations and materials. Other seals, gaskets, films, greases, coating, anodizing, or surface treatments can be employed on the faying surfaces to prevent dust, dirt, or moisture incursion into the waveguide conduits or surrounding features. Conductive grease may be employed instead of or in addition to an EMI seal. The type of additional seals or surface features can be dependent upon the environment into which the waveguide connectors are employed. The various cross-sectional views below further highlight this gap and combined resonant volume.

Figure 4:
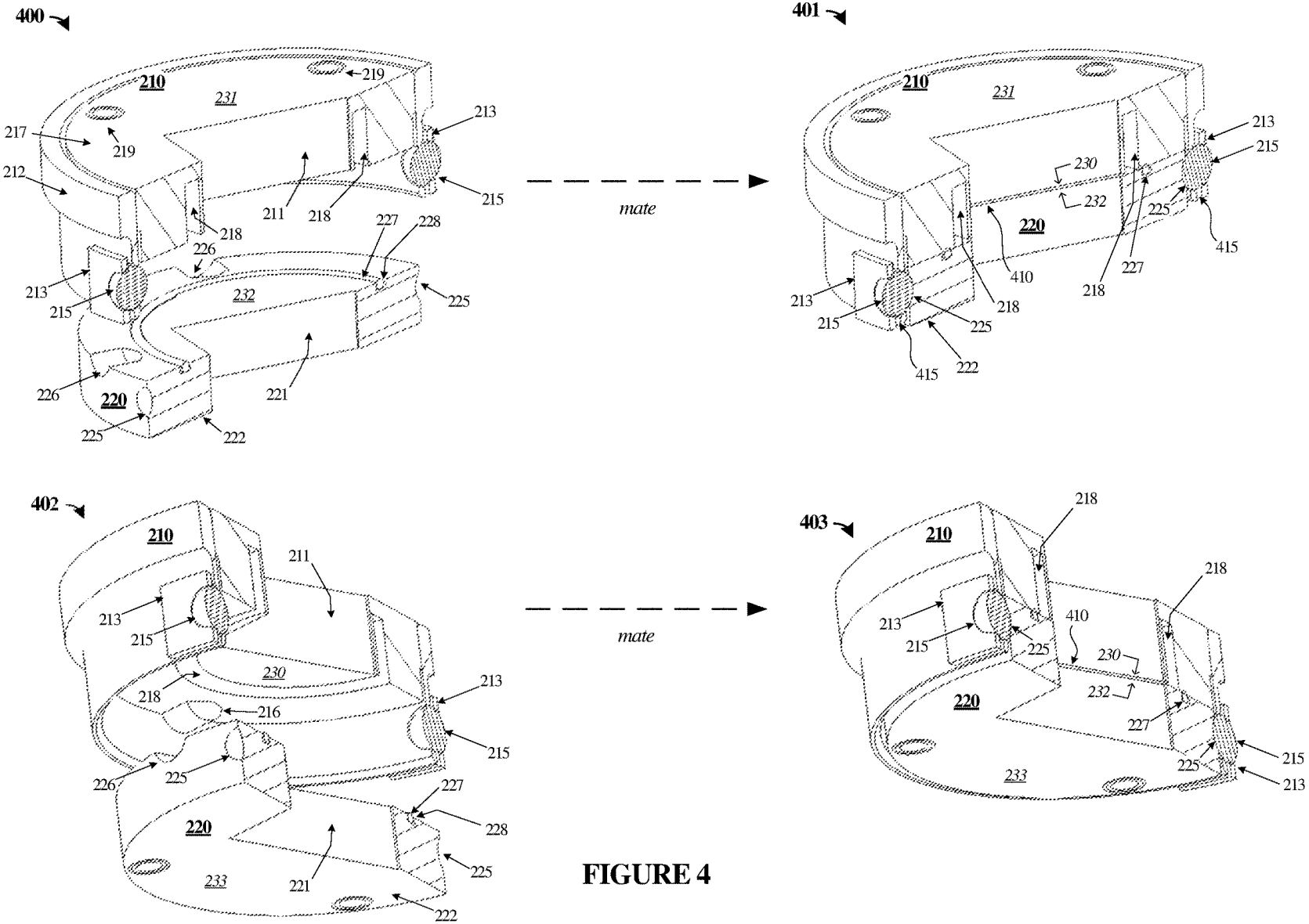
FIG. 4 illustrates a waveguide coupler arrangement in an implementation.

FIG. 4 illustrates additional detailed views of a separable waveguide connector and associated portions or halves. View 400 is a cross-sectional isometric view illustrating connector portion 210 and connector portion 220 in a decoupled configuration. View 401 is cross-sectional isometric view illustrating connector portion 210 and connector portion 220 in a coupled or mated configuration. View 402 is a cross-sectional isometric view illustrating connector portion 210 and connector portion 220 in a decoupled configuration. View 403 is cross-sectional isometric view illustrating connector portion 210 and connector portion 220 in a coupled or mated configuration. The cross-section taken in FIG. 4 is diagonally through opposing corners of the rectangular waveguide cavities. Although similar elements are included in FIG. 4 as found in FIGS. 2 and 3, it should be understood that variations are possible.

In particular, the views in FIG. 4 allow for visibility of a coupled waveguide conduit 211 and 221, along with resonant cavity 218 and EM seal cavity 228. FIG. 4 also illustrates a cross-sectional configuration of ball elements 215 penetrating collar element 212. Turning first to a discussion on resonant cavity 218 and EM seal cavity 228, when faying surfaces 230 and 232 are coupled (views 401, 403) gap 410 might be provided due to intentional machining or due to mechanical tolerances between connector portions. Gap 410 can establish a resonant volume comprising the gap between faying surfaces, resonant cavity 218, and waveguide cavities 211/221. As stated above, properties of gap 410 and resonant cavity 218 can be selected to reduce the effects of reflections, signal self-mixing, and PIM when waveguide cavities 211/221 are coupled. RF coupling between faying surfaces 230/232 can be further enhanced by EMI seal 227 positioned into EM seal cavity 228. EMI seal 227 effectively closes gap 410 in an axial direction. EMI seal 227 and resonant cavity 218 (choke) thus mitigate small planar or axial motions and/or manufacturing or assembly misalignments between connector portion 210 and connector portion 220.

Operation of ball elements 215 is also illustrated in FIG. 4. In views 400 and 402, ball elements 215 are shown as held against collar element 212 by spring element 213. A portion of ball elements 215 penetrates through collar element 212 through holes formed into collar element 212 such that ball element 215 can contact member 222 of connector portion 220 during insertion of member 222 into a shell created by collar element 212 and connector portion 210. Once contact is established with member 222 by ball elements 215, a spring force provided by spring element 213 allows for travel outward from a center by ball elements 215 to conform to an outer perimeter of member 222. Further insertion of member 222 into the shell created by collar element 212 allows for ball elements 215 to seat into divots 225 in member 222 (views 401, 403). The spring force applied to ball elements 215 by spring element 213, as held against collar element 212 by element 214, provides for retention of ball elements 215 within divots 225 and likewise retention of connector portion 210 to connector portion 220 in the axial direction. Concurrent with the operation of ball elements 215, radial alignment features 216/226 will self-align due to the geometric configuration of the features to also nest and provide radial alignment between member 222 and member 217.

Figure 5:
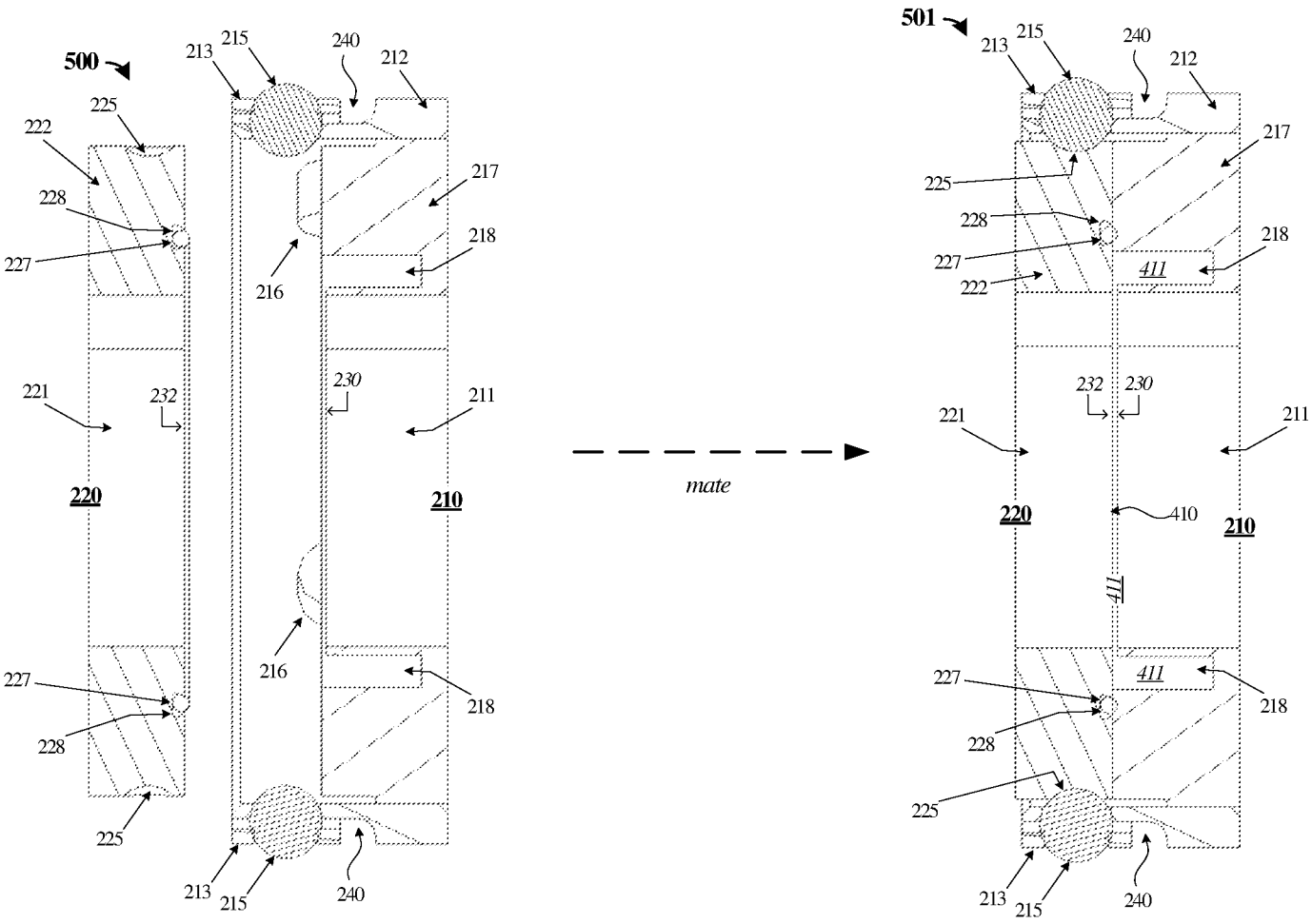
FIG. 5 illustrates a waveguide coupler arrangement in an implementation.

FIG. 5 illustrates additional detailed views of a separable waveguide connector and associated portions or halves. View 500 is a cross-sectional side view illustrating connector portion 210 and connector portion 220 in a decoupled configuration. View 501 is cross-sectional side view illustrating connector portion 210 and connector portion 220 in a coupled configuration. The cross-section taken in FIG. 5 is diagonally through opposing corners of the rectangular waveguide cavities. Although similar elements are included in FIG. 5 as found in FIGS. 2-4, it should be understood that variations are possible.

In particular, the views in FIG. 5 allow for visibility of a coupled waveguide conduit, along with resonant cavity 218 and EM seal cavity 228. FIG. 5 also illustrates a cross-sectional configuration of ball elements 215 penetrating collar element 212. Turning first to a discussion on resonant cavity 218 and EM seal cavity 228, when faying surfaces 230 and 232 are coupled (view 501) gap 410 might be provided due to intentional machining or due to mechanical tolerances between connector portions. Gap 410 can establish resonant volume 411 comprising the gap between faying surfaces, resonant cavity 218, and waveguide cavities 211/221. As stated above, properties of gap 410 and resonant cavity 218 can be selected to reduce the effects of reflections, signal self-mixing, and PIM when waveguide cavities 211/221 are coupled. RF coupling between faying surfaces 230/232 can be further enhanced by EMI seal 227 positioned into EM seal cavity 228. EMI seal 227 effectively closes gap 410 and resonant volume 411 in an axial direction.

Operation of ball elements 215 is also illustrated in FIG. 5. In view 500, ball elements 215 are shown as held against collar element 212 by spring element 213. A portion of ball elements 215 penetrates through collar element 212 while being retained by element 213 such that ball element 215 can contact member 222 of connector portion 220 during insertion of member 222 into a shell created by collar element 212 and connector portion 210. Once contact is established with member 222 by ball elements 215, a spring force provided by spring element 213 allows for travel outward from a center by ball elements 215 to conform to an outer perimeter of member 222. Further insertion of member 222 into the shell created by collar element 212 allows for ball elements 215 to seat into divots 225 in member 222 (view 501). The spring force onto ball elements 215 by spring element 213, as secured to collar element 212 by element 214, provides for retention of ball elements 215 within divots 225 and likewise retention of connector portion 210 to connector portion 220 in the axial direction.

View 501 also illustrates a possible configuration during manufacturing of waveguide cavities within connector portions 210 and 220, as well as manufacturing of certain alignment features. Members 217 and 222 can be formed from a single workpiece of material or formed from separate workpieces which are then clamped or otherwise fastened together. From there, waveguide cavities 211 and 221 can be formed concurrently, ensuring a matched conduit is formed in both workpieces (or the single workpiece). In examples where two workpieces are employed, forming waveguide cavities 211 and 221 can entail machining material from members 217 and 222 while members 217 and 222 are coupled together at faying surfaces 230 and 232. Also, waveguide interface or mating surfaces 231 and 233 can be formed on members 217 and 222. Waveguide mating surfaces are formed on opposite sides of the respective members from that of the faying surfaces, and can be established as having waveguide bolt patterns or other waveguide interface features. Each waveguide mating surface might have a different waveguide bolt pattern if different types or interfaces of waveguides are used for each portion of the connector.

Figure 6:
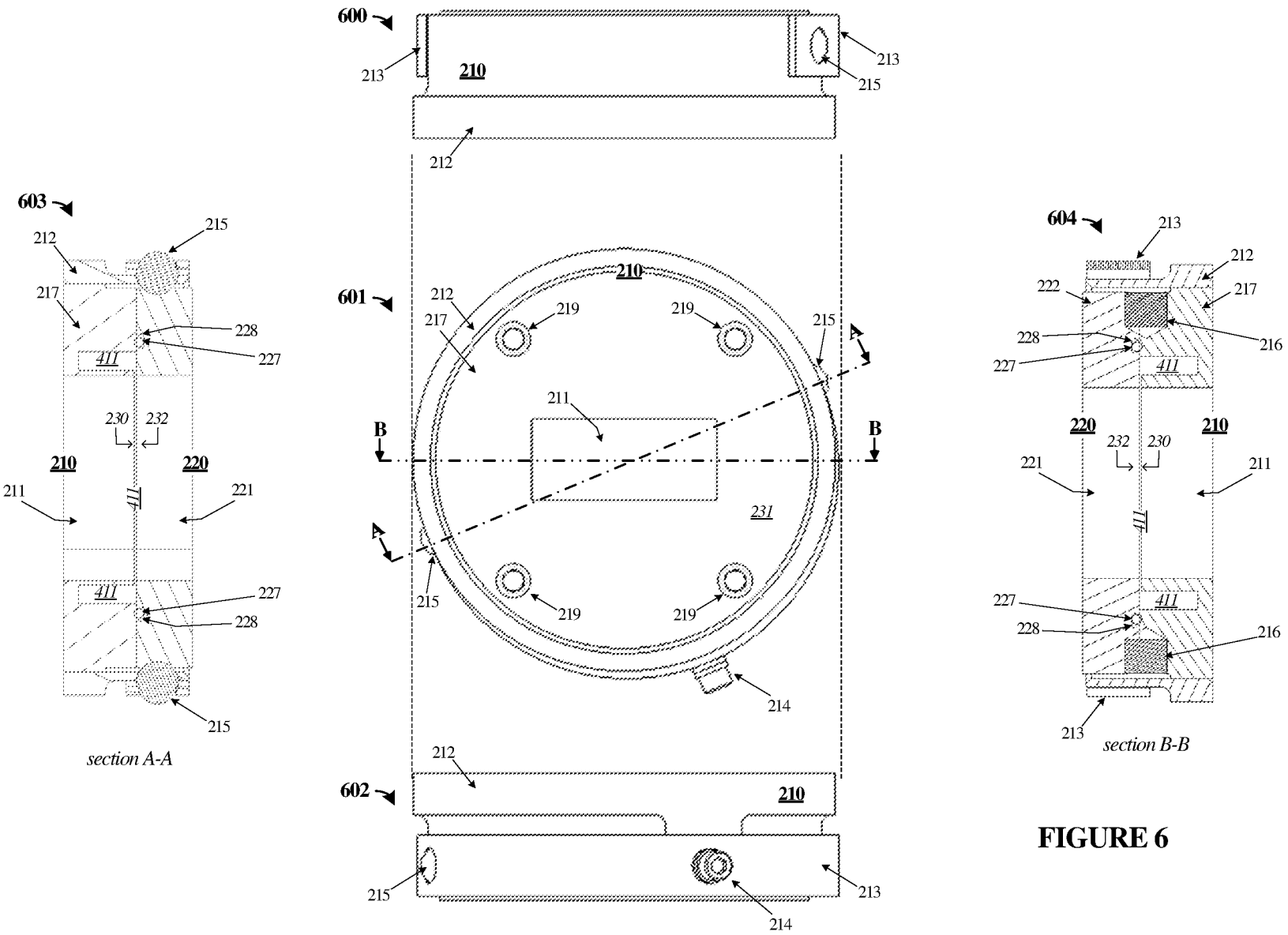
FIG. 6 illustrates a waveguide coupler arrangement in an implementation.

FIG. 6 illustrates additional cross-sectional views including first side view 600, top view 601, second side view 602, cross-section view 603 (section A-A), and cross-section view 604 (section B-B). Top view 601 looks down the axial direction of the waveguide cavities at waveguide interface surface 231, and views 600 and 602 allow for a full view of the sides of collar element 212 having spring element 213, spring retention element 214, and ball elements 215. View 603 provides a similar view to that of 501 in FIG. 5. However, view 604 allows for visibility of the radial alignment features which are hidden from view in many other Figures. Specifically, view 604 shows the nesting of alignment protrusions 216 into alignment channels 226 after coupling of connector portion 210 with connector portion 220. From this nesting, alignment of waveguide conduit 211 is ensured to be within a selected angular or radial alignment with waveguide conduit 221.

View 604 also illustrates a possible configuration providing for concurrent manufacturing of holes for mounting alignment protrusions 216 and formation of alignment channels 226. Radial holes can be bored that span across a faying interface between members 217 and 222 to form the radial alignment features. Specifically, a hole can be bored for each radial alignment feature through an outer perimeter of the combination workpiece of members 217 and 222. This hole can be formed using various milling or drilling techniques, among others. Cavities for mounting the alignment protrusions and cavities comprising the alignment channels can be formed by at least milling holes into members 217 and 222 while members 217 and 222 are coupled together at faying surfaces 230 and 232. Using this technique, planar alignment of a rectangular waveguide conduit is ensured by matched radial holes that span the faying interface plane with pins (alignment protrusions 216) of equal diameter inserted therein. The holes can each be fitted with alignment protrusions 216 comprising cylindrical members s. Centers of the bore holes can be biased toward member 217 and away from member 222 to provide for self-capture of alignment protrusions 216 into member 217 when surrounded by collar element 212. In this manner, alignment protrusions 216 are retained within member 217 and will not fall out of member 217 yet still provide for radial alignment when nested with alignment channels 226. Since the bore holes for mounting of alignment protrusions 216 are formed concurrently in both members 217 and 222, radial alignment can be guaranteed among members 217 and 222 and of waveguide cavities 211 and 221. Other possible examples of retaining alignment protrusions 216 can be employed, such as threaded features which thread alignment protrusions 216 into member 217, welds, or adhesives. Advantageously, the radial pin orientation discussed for alignment protrusions 216 prevents the possibility of binding that would occur if other types of alignment features were employed. For example, if alignment pins were coaxial with the waveguide conduit and penetrated axially into an opposing faying surface, these pins have a tendency to bind or catch during insertion or removal. Moreover, cold welding in vacuum environments are more prevalent using such an axial pin configuration.

Also, formation of the axial alignment features can also occur concurrently in both member 217 and 222. For example, collar element 212 might be mounted to member 217 while member 217 and 222 are coupled together during manufacturing, as noted above. Holes can be bored through collar 212 and into member 222 to form self-aligned divots 225 that carry ball elements 215. From here, a ball detent assembly can be formed by at least attaching spring element 213 to collar element 212 to retain ball elements 215 within these holes formed into collar element 212.

Although some manufacturing techniques have been discussed above which provide for enhanced alignment in the axial and radial directions, and alignment of waveguide cavities, other manufacturing techniques can be employed. For example, a single workpiece might be used to form the above features, and then the single workpiece can be cut into portions forming members 217 and 222 along with faying surfaces. In other examples, additive or 3D manufacturing techniques can be used to form a single workpiece with alignment features. Various materials can be employed to form the elements discussed above, such as aluminum, copper, steel, magnesium, or other materials, including combinations, alloys, and variations thereof. Typically, the walls of the waveguide cavities and resonant cavities will be formed from a conductive material, such as a metal or metal alloy, which may comprise a dielectric substrate coated or laminated with conductive material. In some example, members 217 and 222 can be formed from one material/metal (e.g. aluminum) while mating features formed from another material/metal (e.g. steel) to reduce sticking, galvanic corrosion, or cold welding between moving/mating features and members 217 and 222. Example features which might be of a dissimilar material than members 217 and 222 can be alignment protrusions 216 and ball elements 215, among others.

The functional block diagrams, operational scenarios and sequences, and flow diagrams provided in the Figures are representative of exemplary systems, environments, and methodologies for performing novel aspects of the disclosure. While, for purposes of simplicity of explanation, methods included herein may be in the form of a functional diagram, operational scenario or sequence, or flow diagram, and may be described as a series of acts, it is to be understood and appreciated that the methods are not limited by the order of acts, as some acts may, in accordance therewith, occur in a different order and/or concurrently with other acts from that shown and described herein. For example, those skilled in the art will understand and appreciate that a method could alternatively be represented as a series of interrelated states or events, such as in a state diagram. Moreover, not all acts illustrated in a methodology may be required for a novel implementation.

The various materials and manufacturing processes discussed herein are employed according to the descriptions above. However, it should be understood that the disclosures and enhancements herein are not limited to these materials and manufacturing processes, and can be applicable across a range of suitable materials and manufacturing processes. Thus, the descriptions and figures included herein depict specific implementations to teach those skilled in the art how to make and use the best options. For the purpose of teaching inventive principles, some conventional aspects have been simplified or omitted. Those skilled in the art will appreciate variations from these implementations that fall within the scope of this disclosure. Those skilled in the art will also appreciate that the features described above can be combined in various ways to form multiple implementations.

What is claimed is:

1. An apparatus, comprising:

a collar element surrounding a member comprising a faying surface, a waveguide conduit, and alignment protrusions arranged radially about a perimeter of the faying surface, wherein the collar element is configured to accept insertion of a mating member comprising a mating faying surface and a mating waveguide conduit;

a ball detent assembly having a spring element that retains ball elements in holes formed through the collar element;

wherein the waveguide conduit and the mating waveguide conduit are configured to be aligned radially by at least engagement of the alignment protrusions with alignment channels in the mating member and restrained axially by at least engagement of the ball elements with mating divots in the mating member.

2. The apparatus of claim 1, wherein the waveguide conduit is surrounded by an annular resonant cavity formed through the faying surface and into the member, wherein the annular resonant cavity shares a volume with a gap separating the faying surface when mated to the mating faying surface.

3. The apparatus of claim 1, comprising:

an annular gasket element configured to conductively span a gap between the faying surface and the mating faying surface and fit into a gasket cutout formed into at least one among the member and the mating member.

4. The apparatus of claim 1, comprising:

the alignment protrusions comprising cylindrical elements horizontally mounted into the member and having a majority of a volume recessed into the member from the faying surface to provide for capture of the cylindrical elements into the member when surrounded by the collar element.

5. The apparatus of claim 1, wherein resistance to a separation force is established by engagement of the ball elements with the mating divots to maintain an axial alignment and resist separation of the faying surface from the mating faying surface.

6. The apparatus of claim 1, wherein the spring element comprises a lever structure wrapped about at least a portion of an exterior of the collar element and coupled at a fulcrum point to the collar element, wherein arms of the lever structure engage the ball elements and push the ball elements through the holes in the collar element for engagement with the mating divots in the mating member.

7. The apparatus of claim 1, wherein the member comprises a waveguide mating surface opposite from that of the faying surface and configured to mate with a waveguide having waveguide interface features.

8. The apparatus of claim 7, wherein the waveguide interface features comprise a bolt pattern configuration supporting a waveguide type selected from among a rectangular waveguide type, circular waveguide type, and double ridged waveguide type.

9. A separable waveguide connector system, comprising:

a first connector assembly comprising:

a collar element surrounding a member;

the member comprising a faying surface, a waveguide conduit, and alignment protrusions arranged radially about a perimeter of the faying surface; and a ball detent assembly having a spring element that retains ball elements in holes formed through the collar element;

a second connector assembly comprising:

a mating member comprising a mating faying surface having alignment channels, a mating waveguide conduit, and mating divots formed along an outer edge of the mating member;

wherein the mating member is configured to be inserted into the collar element, with alignment of the waveguide conduit with the mating waveguide conduit established by at least engagement of the alignment protrusions with alignment channels and engagement of the ball elements with mating divots.

10. The separable waveguide connector system of claim 9, wherein the waveguide conduit is surrounded by an annular resonant cavity formed through the faying surface and into the member, wherein the annular resonant cavity shares a volume with a gap separating the faying surface when mated to the mating faying surface.

11. The separable waveguide connector system of claim 9, comprising:

an annular gasket element configured to conductively span a gap between the faying surface and the mating faying surface and fit into a gasket cutout formed into at least one among the member and the mating member.

12. The separable waveguide connector system of claim 9, comprising:

the alignment protrusions comprising cylindrical elements horizontally mounted into the member and having a majority of a volume recessed into the member as referenced from the faying surface to provide for capture of the cylindrical elements into the member when surrounded by the collar element.

13. The separable waveguide connector system of claim 9, wherein resistance to a separation force is established by engagement of the ball elements with the mating divots to maintain an axial alignment and resist separation of the faying surface from the mating faying surface.

14. The separable waveguide connector system of claim 9, wherein the spring element comprises a lever structure wrapped about at least a portion of an exterior of the collar element and coupled at a fulcrum point to the collar element, wherein arms of the lever structure engage the ball elements and push the ball elements through the holes in the collar element for engagement with the mating divots in the mating member.

15. The separable waveguide connector system of claim 9, the first connector assembly comprising a waveguide mating surface opposite from that of the faying surface and configured to mate with a waveguide having waveguide interface features.

16. The separable waveguide connector system of claim 15, wherein the waveguide interface features comprise a bolt pattern configuration supporting a waveguide type selected from among a rectangular waveguide type, circular waveguide type, and double ridged waveguide type.

17. A method, comprising:

forming a first member comprising a first faying surface, a first waveguide conduit, and alignment protrusions arranged radially about a perimeter of the first faying surface;

forming a connector assembly comprising the first member coupled to a collar element surrounding a perimeter of the first member;

forming a ball detent assembly by at least attaching a spring element to the collar element retain ball elements within holes formed into the collar element;

forming a second member comprising a second faying surface having alignment channels, a second waveguide conduit, and mating divots formed along an outer edge of the second member, wherein the second member is sized to be insertable into the collar element to mate the first faying surface to the second faying surface.

18. The method of claim 17, further comprising:

forming the first waveguide conduit and the second waveguide conduit by at least machining material from the first member and the second member while the first member and the second member are coupled together at the first faying surface and the second faying surface.

19. The method of claim 17, further comprising:

forming cavities for the alignment protrusions and the alignment channels by at least milling holes into the first member and the second member while the first member and the second member are coupled together at the first faying surface and the second faying surface, wherein the holes each house one of the alignment protrusions, and wherein centers of the holes are biased toward the first member to provide for capture of the alignment protrusions into the first member when surrounded by the collar element.

20. The method of claim 17, further comprising:

forming a first waveguide mating surface opposite from that of the first faying surface and having a first type of waveguide interface features; and forming a second waveguide mating surface opposite from that of the second faying surface and having a second type of waveguide interface features.

* * * * *